US006863213B2

(12) United States Patent
Goedickemeier et al.

(10) Patent No.: US 6,863,213 B2
(45) Date of Patent: Mar. 8, 2005

(54) METHOD AND SYSTEM FOR PROVIDING A DECISION SUPPORT FOR USERS FOR SELECTING DRILLING AND CUTTING ELEMENTS FOR USE IN A CONSTRUCTION MATERIAL REGION

(75) Inventors: Martin Goedickemeier, Gais (CH); Reinhard Schindler, Lustenau (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/456,337

(22) Filed: Jun. 5, 2003

(65) Prior Publication Data

US 2004/0050926 A1 Mar. 18, 2004

(30) Foreign Application Priority Data

Jun. 7, 2002 (DE) ..... 102 25 274

(51) Int. Cl.[7] ..... G06F 17/00
(52) U.S. Cl. ..... 235/375
(58) Field of Search ..... 235/375; 175/24, 175/40; 81/121.1

(56) References Cited

U.S. PATENT DOCUMENTS 4,982,627 A 1/1991 Johnson ..... 81/121.1
6,276,465 B1 8/2001 Cooley et al. ..... 175/24
6,612,382 B2 * 9/2003 King ..... 175/40

* cited by examiner

*Primary Examiner*—Karl D. Frech
*Assistant Examiner*—April Taylor
(74) *Attorney, Agent, or Firm*—Sidley Austin Brown & Wood, LLP

(57) ABSTRACT

The invention relates to a method and a system for providing a decision support for users for selecting drilling and cutting elements for use in a construction material region, wherein areas of application of aggregate materials for concrete as a factor of the different drilling and cutting resistances of the aggregate materials in the zones are grouped in a geographical information storage medium. In this geographical information storage medium, a reference number is assigned to each of the zones, which represent a drilling and cutting resistance of a specific magnitude. The drilling and cutting elements to be used in an area of application of aggregate materials of specific drilling and cutting resistance are provided with a reference number corresponding to the reference number of the zones.

4 Claims, 2 Drawing Sheets

Figure 1:
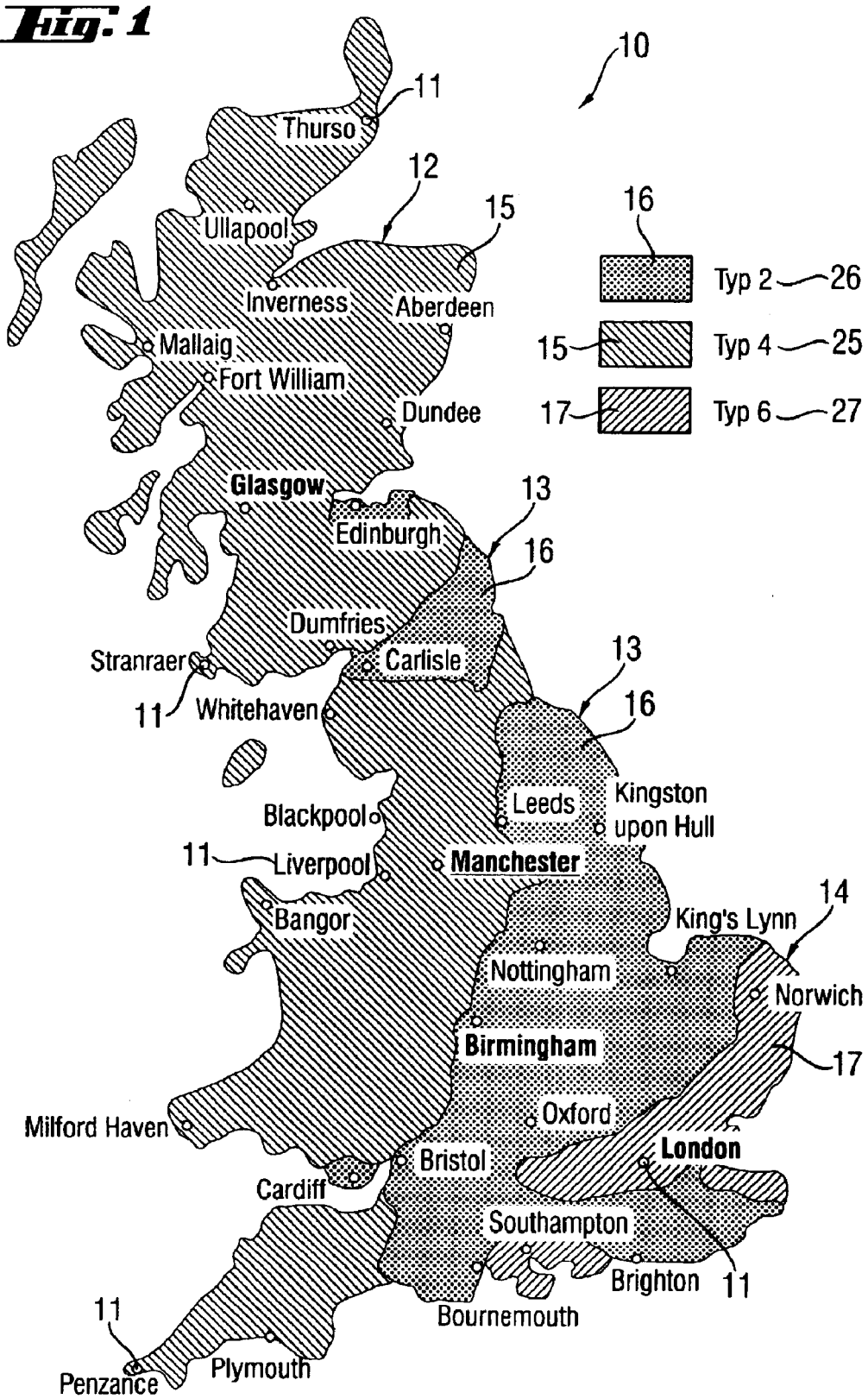

METHOD AND SYSTEM FOR PROVIDING A DECISION SUPPORT FOR USERS FOR SELECTING DRILLING AND CUTTING ELEMENTS FOR USE IN A CONSTRUCTION MATERIAL REGION

BACKGROUND OF THE INVENTION

The present application relates to a system and method for providing a decision support for users for selecting drilling and/or cutting elements. The method comprises the steps of grouping areas of application of aggregates for concrete as a factor of different drilling and cutting resistances of the aggregates into zones in a geographical information storage medium; associating each of the zones with a reference number that reflects the specific magnitude of at least one of a drilling resistance and cutting resistance; and providing the drilling element and cutting element with a corresponding reference number corresponding to the reference numbers of the zones.

According to the state of technology in drilling and/or cutting elements, these are specified for example, from the company catalog of Hilti AG, Version 2001, Austria, pp. 87–89, for use with materials of specific hardness. When dealing with a construction material such as concrete, for example, the user must initially determine the hardness or the drilling or cutting resistance of the concrete he intends to drill or to cut, before he can select the correct drilling or cutting element using the specification. The drilling or cutting resistance of a concrete is determined by the aggregate materials that were added to the basic concrete mix.

SUMMARY OF THE INVENTION

The object of the present invention is to provide the user with a method and a system that facilitates the selection of drilling and cutting elements for use with concrete in a specific instance of utilization.

This is achieved by a method in accordance with the invention. According to the method, on or in a geographical information storage medium, the areas of application of aggregate materials of identical hardness class or identical drilling or cutting resistance class are provided with a uniform reference numbers. The aggregate materials are thus initially classified according to their hardness or their drilling or cutting resistance. The user can then easily retrieve the reference number from the geographical information storage medium for his work site. The reference number corresponds to a specific hardness class or drilling or cutting resistance class of the usual aggregate materials for concrete for the work location. An identical reference number is, according to the method, appropriate to the drilling and cutting elements, for which the respective hardness or drilling or cutting resistance class is/are specified, so that the user can easily select the required drilling or cutting element using its reference number.

It is advantageous, if the geographical information storage medium is configured as a card that also contains geographical locale information. The user can easily retrieve the reference number from the conveniently portable card, which according to the invention facilitates the selection of the required drilling or cutting elements.

The geographical information storage medium could, for example, also include a microcomputer or other form of electronic data storage medium, in which the reference number is stored according to geographical coordinates. This geographical information storage medium could, for example, also pick up satellite-supported geographical information regarding the user's location and automatically output the reference number associated with that location.

The object is further achieved by a system with the characteristics disclosed in patent claim 3, which has the same advantages, as the method according to the invention. In this context reference is made in the full scope to the aforesaid description.

BRIEF DESCRIPTION OF THE INVENTION

Figure 2:
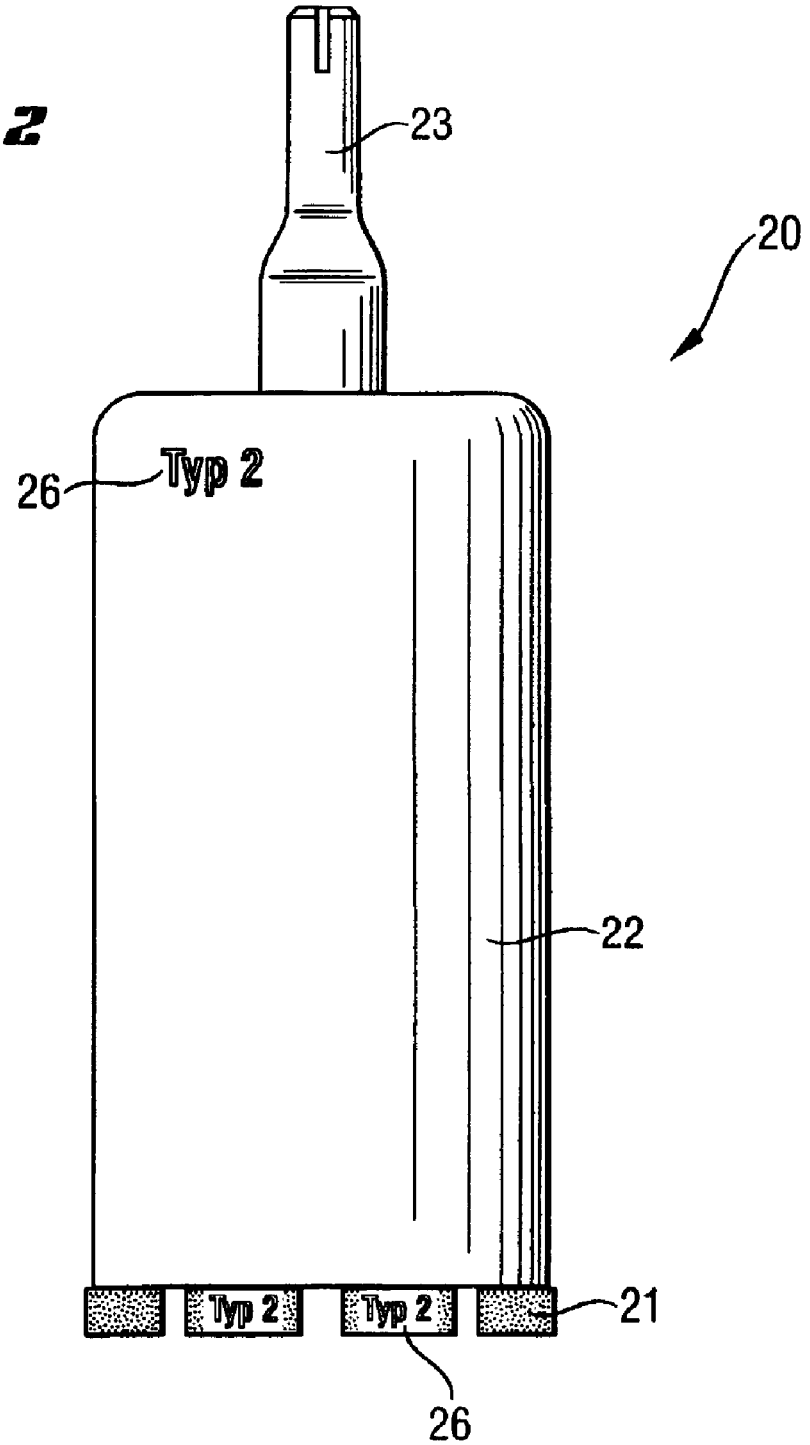

Other advantages and processes of the invention are described in the following description with reference to the drawings, wherein:

FIG. 1 shows a geographical information storage medium in the form of a card according to the invention; and FIG. 2 shows a core drill element according to the invention.

DETAILED DESCRIPTION OF THE INVENTION

FIG. 1 shows an example of a geographical information storage medium 10 in the form of a card. In this geographical information storage medium 10, geographical locale specifications 11 are reproduced, which are used by the user of the card when entering his location on the geographical information storage medium 10 or on the card. In the geographical information storage medium 10, in the present example, zones 12, 13 and 14 are executed as zones and provided with the different reference numbers 15, 16, 17. These zones 12, 13, 14 correspond to the areas of application of aggregates of specific hardness or specific drilling or cutting resistance. In other words, for example, for zone 12, which is provided with reference number 15, the aggregate materials have a drilling or cutting resistance of magnitude X, whilst the aggregate materials in the area of application of zone 13 and which are provided with reference number 16, have a drilling or cutting resistance of Y, which, for example, is greater than the drilling or cutting resistance X, which corresponds to reference 15. If the user of drilling or cutting elements is faced with the task of drilling through a concrete wall in a locale which is in the geographical information storage medium 10, for example, located in a region 12, he can then retrieve from the geographical information storage medium 10 the indicia 16 (15, 17) for the region 12 (12, 14), which is also listed in a legend in the geographical information storage medium 10. The user must then merely select an identical corresponding reference 26 on the drilling or cutting element from the product line.

A core drilling element 20 according to the invention is shown in FIG. 2. This core drilling element 20 comprises the drill mantel 22, which is configured as a cylinder and at whose open end there are cutting elements 21. These cutting elements 21 can, for example, be diamond cutting elements. A coupling element 23 is arranged at the opposing, closed end of the drill mantle 22, by which the core drill element 20 can be connected to a motor-driven drilling tool (not shown). The corresponding reference number 26 is arranged at different places on the core drill element 20, in this case shown only by way of example, the reference number being used by the user for selecting the core drill element 20 responding to the requirements. The reference need not necessarily include letters or numbers; it could just as effectively include other symbols or even color codings.

What is claimed is:

1. A method for providing a decision support for users for selecting a at least one of a drilling element and a cutting element for use in a construction material region, comprising the steps of grouping areas of application of aggregates for concrete as a factor of different at least one of a drilling resistance and cutting resistance of the aggregates into zones (12, 13, 14) in a geographical information storage medium (10);

associating each of said zones (12, 13, 14) with a reference number (15, 16, 17) that reflects a specific magnitude of at least one of a drilling resistance and cutting resistance; and providing the at least one of the drilling element and cutting element (20) to be used in an area of application of aggregate materials of a specific at least one of the drilling resistance and cutting resistance with a corresponding reference number (25, 26, 27) corresponding to the reference numbers (15, 16, 17) of the zones.

2. The method of claim 1, wherein the geographical information storage medium (1) includes a card wherein the zones (12, 13, 14) are surface zones contained in geographical locale specifics (11).

3. A system for providing a decision support for users for selecting at least one of a drilling element and cutting element (20) for use in a construction material region, comprising areas of application of aggregate materials for concrete as a factor of one of a different drilling resistance and cutting resistances of aggregate materials being grouped into a plurality of zones (12, 13, 14) in a geographical information storage medium (10); and a reference number (15, 16, 17) assigned to each of the zones (12, 13, 14) that represent at least one of a drilling resistance and a cutting resistance of a specific magnitude;

wherein the at least one of the drilling element and cutting element (20) to be used in an area of application of aggregate materials of a specific of at least one of the drilling resistance and cutting resistance is provided with a reference number (25, 26, 27) corresponding to the reference number (15, 16, 17) of the zones.

4. The system of claim 3, wherein the geographical information storage medium (10) includes a card wherein the zones are surface zones (12, 13, 14) contained in geographical locale specifics (11).

* * * * *